US009943738B2

(12) United States Patent
Edge

(10) Patent No.: US 9,943,738 B2
(45) Date of Patent: Apr. 17, 2018

(54) MECHANICAL ASSEMBLY FOR CONTROL OF MULTIPLE ORBITING BODIES

(75) Inventor: David Matthew Edge, Velluire (FR)

(73) Assignee: The Boeing Company, Chicago, IL (US)

( * ) Notice: Subject to any disclaimer, the term of this patent is extended or adjusted under 35 U.S.C. 154(b) by 452 days.

(21) Appl. No.: 13/261,381

(22) PCT Filed: Jan. 27, 2011

(86) PCT No.: PCT/US2011/000151

§ 371 (c)(1),
(2), (4) Date: Jul. 19, 2012

(87) PCT Pub. No.: WO2011/094007

PCT Pub. Date: Aug. 4, 2011

(65) Prior Publication Data

US 2012/0329360 A1 Dec. 27, 2012

(51) Int. Cl.

| | |
|---|---|
| ***A63H 1/06*** | (2006.01) |
| ***A63B 67/10*** | (2006.01) |
| ***A63F 7/38*** | (2006.01) |
| *A63F 9/24* | (2006.01) |

(52) U.S. Cl.

CPC ..... *A63B 67/10* (2013.01); *A63F 7/382* (2013.01); *A63F 2009/2451* (2013.01); *A63F 2250/485* (2013.01)

(58) Field of Classification Search

CPC .. A63B 67/10; A63F 7/382; A63F 2009/2451; A63F 2250/485

USPC ..... 446/146, 236, 246, 266

See application file for complete search history.

(56) References Cited

U.S. PATENT DOCUMENTS

| | | | | |
|---|---|---|---|---|
| 139,533 | A * | 6/1873 | Batchelder | 446/247 |
| 665,980 | A * | 1/1901 | Roche | 446/247 |
| 1,331,971 | A * | 2/1920 | Adler | 446/247 |
| 1,538,720 | A * | 5/1925 | Mercer | 273/330 |

(Continued)

FOREIGN PATENT DOCUMENTS

FR 2515054 4/1983

OTHER PUBLICATIONS

English-language abstract of French Patent No. FR 2,515,054, downloaded from espacenet.com, Aug. 21, 2015.

*Primary Examiner* — Melba Bumgarner
*Assistant Examiner* — Joseph B Baldori
(74) *Attorney, Agent, or Firm* — DASCENZO Intellectual Property Law, P.C

(57) ABSTRACT

A mechanism allowing the control of multiple orbiting bodies comprising: a bearing surface (306) which may or may not be integral to a handle (300); a rotatable section (308) free to move through 360 degrees upon the bearing; and, attached to the rotatable section, an array of two or more pendulums (314, 316) which are first whirled in coplanar orbits and subsequently, via changes made to the attitude of the axis of the rotatable section, in precessing, non-coplanar, non-chaotic orbits equaling the pendulums in number. The pendulums may be identical or have differing properties of length, weight, or aerodynamics affecting their relative tendencies to precess and may be decorated and incorporate elements which emit light and/or sound. In certain applications some or all of these characteristics of length, weight, and aerodynamics, as well as the visual and auditory components are customizable.

26 Claims, 4 Drawing Sheets

(56) References Cited

U.S. PATENT DOCUMENTS

| | | | | | |
|---|---|---|---|---|---|
| 1,858,145 | A | * | 5/1932 | Felardo | 446/266 |
| 1,915,868 | A | * | 6/1933 | Rogers | 446/247 |
| 2,684,850 | A | | 7/1954 | Williams | |
| 2,991,585 | A | * | 7/1961 | Drees | 446/266 |
| 3,093,376 | A | * | 6/1963 | Terry | 273/330 |
| 3,157,962 | A | * | 11/1964 | Bonnelly | 446/247 |
| 3,325,940 | A | * | 6/1967 | Davis | 446/242 |
| 3,550,312 | A | * | 12/1970 | East | 446/247 |
| 3,608,235 | A | * | 9/1971 | Harton | 446/247 |
| 3,672,093 | A | * | 6/1972 | Meek, Sr. | 446/266 |
| 3,693,285 | A | * | 9/1972 | Manzo | 446/266 |
| 3,693,286 | A | * | 9/1972 | Marcotti | 446/266 |
| 3,834,069 | A | * | 9/1974 | Brown | 446/250 |
| 4,062,542 | A | * | 12/1977 | Manera | 473/576 |
| 4,333,658 | A | * | 6/1982 | Giovetti | 473/424 |
| D326,484 | S | * | 5/1992 | Nwoke | D21/466 |
| D337,621 | S | * | 7/1993 | Wong | D21/466 |
| 5,314,369 | A | * | 5/1994 | Gamble | 446/247 |
| 5,492,335 | A | * | 2/1996 | Videnov | 473/576 |
| 6,004,184 | A | * | 12/1999 | Piluso | 446/266 |
| 6,227,929 | B1 | * | 5/2001 | Nelson et al. | 446/239 |
| 6,413,099 | B2 | * | 7/2002 | Rainey | 434/191 |
| 6,776,742 | B2 | * | 8/2004 | Domenge | 482/110 |
| 6,802,758 | B2 | * | 10/2004 | Somers | 446/242 |
| 2001/0003644 | A1 | | 6/2001 | Rainey | |
| 2004/0009833 | A1 | * | 1/2004 | Selevan | 473/576 |
| 2012/0329360 | A1 | * | 12/2012 | Edge | 446/146 |

* cited by examiner

MECHANICAL ASSEMBLY FOR CONTROL OF MULTIPLE ORBITING BODIES

TECHNICAL FIELD

The invention presented herein concerns a mechanical assembly allowing the control of a plurality of concentrically orbiting pendulums which may be made through a series of simple movements to revolve first in coplanar and subsequently in non-coplanar orbits. This mechanism has applications in dynamic physical models of orbital systems, in devices for scientific education, specifically yet not solely, in pendular and gyroscopic motion and in optics, and in devices for physical education, as well as in whirling toys and accessories for artistic performance.

BACKGROUND ART

In background art in the field of dynamic physical models of atomic motion there exist no hand-held devices involving two and more pendulums as in the present invention and, as such, none of the background art in this field offers kinesthetic appreciation of the orbital relationships represented. In background art devices in this field the structures representing electrons have revolved in two dimensions or have been attached to spheres, rings, or complex armatures and have not been free to orbit through all positions available within an orbital shell.

In background art in the field of educational devices relating to pendular physics, gyroscopic precession, and orbital systems there exist none employing a plurality of concentric, adjustable, orbiting pendulums and allowing an operator to induce precession and subsequent intersecting non-coplanar orbits of said pendulums.

In background art in the field of whirling toys involving two counter-rotating tethered objects it is intended that the tethers be counter-rotating and non-coplanar from the commencement of operation. Said background art has not relied upon precession of the orbiting tethers for the establishment of non-coplanar orbits. In none of said background art are two or more tethers attached to a shared rotatable structure. In such background art in this field where provision is made for the potential use of more than two whirling objects said objects are attached to the handle of the device in such a way as to specifically prevent precession of the orbiting members and the resultant intersection of orbital planes. In none of said prior art devices do the orbits of three and more independent pendulums or tethers share a common center. There exist no prior art devices employing more than two pendulums in precessing, non-coplanar, concentric orbits.

In background art in the field of whirling toys of the sort comprising a disc suspended on a loop of cord encircling both hands of an operator and incorporating a plurality of light-emitting structures said structures are constrained to coplanar orbits or to parallel orbital planes and their operation does not proceed in the manner of the present invention. Relevant prior art of which I am aware includes:

In the field of whirling toys:

U.S. Pat. No. 128,239 Morris, 1872
U.S. Pat. No. 139,533 Batchelder, 1873
U.S. Pat. No. 610,600 Davis, 1898
U.S. Pat. No. 1,374,002 Edson, 1921
U.S. Pat. No. 1,858,145 Felardo, 1930
U.S. Pat. No. 1,915,868 Rogers, 1933.
U.S. Pat. No. 1,932,943 Smith, 1933
U.S. Pat. No. 3,325,940 Davis, 1967
U.S. Pat. No. 3,009,285 Brown, 1961

U.S. Pat. No. 3,010,249 Sirks, 1961
U.S. Pat. No. 3,157,962 Bonnely, 1964
U.S. Pat. No. 3,461,603 Rowell, 1966
U.S. Pat. No. 3,608,235 Harton, 1971
U.S. Pat. No. 5,314,369 Gamble, 1994
U.K. Patent GB416853 (A) Butler, 1934
U.K. Patent GB2325174 (B) Tett, 2000
U.K. Patent GB2374554 (A) Zabrana, 2002

In the field of orbital systems dynamics:

U.S. Pat. No. 2,204,952, Wittigschlager, 1940
U.S. Pat. No. 2,601,729 Underwood, 1952
U.S. Pat. No. 5,695,344 Tomasello, 1997

DISCLOSURE OF INVENTION

Motifs incorporating concentric circles, interlocking rings, and nesting spheres are common in the histories of artistic, philosophical, religious, and scientific thought. The convergence of these diverse fields upon these shared physical forms has rendered these motifs particularly captivating to people, as evidenced by their widespread current use in commercial art.

It is an object of the present invention to offer a mechanism which incorporates this powerful imagery and can, furthermore, contribute to the understanding and greater appreciation of each of the aforementioned domains of human endeavor.

A second object of the present invention is to provide a simple device capable of presenting, in dynamic, physical form, an orbital system similar to the Bohr model of atomic structure, which is the model most widely employed to introduce the concept to students.

A third object of the invention is to provide a mechanism which can simultaneously provide amusement, develop coordination through physical exercise, and offer an opportunity for discovery through intellectual and kinesthetic exploration of scientific principals.

The present invention resides in a mechanical assembly comprising:

- A bearing or bearing surface which may be integral to a handle;
- A section positioned or positionable upon and rotatable through 360 degrees upon or around said bearing or bearing surface and hereinafter referred to as a bail;
- An array of pendular members hereinafter referred to as orbiters, detachably or permanently attached to the bail and whose specific physical characteristics and tendencies toward precession when orbiting may be identical or different depending on the application.

The orbiters are attached to the bail in such a way as to hang freely when at rest and to assume radial orientation with respect to the bail when whirled simultaneously, in one direction, and in a single plane or in parallel planes, depending on the embodiment in question, around the bail's axis of rotation on the bearing.

The orbiters of an array may be identical, but for optimum ease of operation, and specifically in arrays intended for beginning operators or involving large numbers of orbiters, the orbiters' lengths, weights, aerodynamic properties or a combination thereof are arranged such that the orbiters will react at different rates and to differing degrees to changes made to the orientation of the axis of rotation of the bail, said changes being effectively the introduction of a secondary axis having for its center the wrist, elbow or shoulder of the operator and on which the entire assembly is made to revolve in a precessing manner in a direction opposite that of the bail's primary rotation. As the revolving orbiters react differently to this stimulus they can be caused, through the inducement of gyroscopic precession, to orbit on non-parallel planes. When this occurs, tertiary axes specific to the individual orbiters are created, having for their centers the points of attachment of the orbiters to the bail.

In order for operation to proceed as in the following two examples and as detailed below in the discussion of the attached figures and in the explanatory section titled Operation, the operator must begin by whirling the array of orbiters in such a way that the most reactive orbiter (if differences exist) precedes the others as they move through space, in order to minimize the likelihood of collision, as will become apparent through examination of the accompanying figures.

EXAMPLE 1

The effect created through the basic operation of such a mechanism equipped with a symmetrical bail and with an array of two orbiters of unequal length is the independent non-coplanar revolution of the two orbiters, and the rotation on a secondary, precessing axis, of the ring described by die free end of the shorter, more reactive orbiter within the greater ring described by the free end of the longer and Less reactive orbiter.

EXAMPLE 2

The basic effect of such a mechanism equipped with a symmetrical bail and with an array of three orbiters of unequal length is the independent non-coplanar revolution of the three orbiters and the rotation of the ring described by the shortest orbiter within the ring described by the mid-length orbiter, which is itself rotating within that described by the longest orbiter.

Other movements of the operator's body may be employed to speed, to slow, or to halt precession of one or more of the orbiters, or for example to cause the largest of the orbits to rotate around those contained by it, and are explained further in the sections titled Assembly and Operation. The two-orbiter configuration and other arrays of orbiters are included in the accompanying figures and discussion.

Assembly

Bearings:

In the assembly of the present invention any sort of bearing mechanism may be employed, so long as it allows proper rotation of the bail and of an attached array of orbiters.

Bails:

A variety of bails may be employed, which may be flexible or rigid and of any suitable material and manufacture, as long as rotation on the bearing and attachment of the orbiters are provided for. The bail may be symmetrical or asymmetrical. Bail asymmetry may, for example, be used to create the illusion of same-length orbiters, when although the distance from bail axis to orbiter end is identical for all orbiters in the array, the actual length of the free orbiters varies from one to the next, and their behaviors vary accordingly.

Orbiters and Arrays:

A variety of orbiters may be employed. The orbiters may be of any number greater than one, provided that their disposition on the bail and their properties of length, weight, and tendency to precess allow for the proper operation of the device in accordance with the explanations made in the present document.

The orientation of the points of attachment of the orbiters in relation to the axis of rotation of the bail may be parallel, perpendicular or diagonal and the points of attachment may be arranged in a linear or non-linear fashion. Arrangements of orbiters which are diagonal or parallel to the axis of rotation of the bail may be used to similar effect as those of bail asymmetry, as a point of attachment further from the hand of the operator is subject to greater movement with each change made to the attitude of the device than is a point of attachment closer to the hand of the operator, and orbiters attached thereto are affected to a greater degree.

The orbiters may be flexible or rigid. With flexible orbiters constructed of braided cord or like material it is preferable to include a swivel mechanism to minimize twisting and resultant tangling of the orbiters. Swivel mechanisms are not necessary in arrays of rigid orbiters, but they may be included to smooth the operation of the device.

The orbiters may be simple or decorated or shaped along their length for optical effect. They may be equipped internally or externally with a single fixed or movable object or with a plurality of fixed or movable objects. Said objects may be of diverse natures including but not limited to light- or sound-emitting elements and including but not limited to objects capable of exerting an effect on the trajectory of the orbiter, such as movable weights, weights reactive to centripetal force, spinning objects, or airfoils. The orbiters of a given array need not be of the same materials. The orbiters may be of fixed form or may elongate when subjected to centripetal force. The orbiters may be interchangeable. They may be modifiable in length, width, weight, appearance, and function for purposes of creation of novel visual or auditory effect and experimentation by the operator. There is a necessary correlation between the length and weight of the orbiters, and devices intended for use by children must necessarily be both lighter and smaller than devices intended for use by adults. It is possible through variation in these characteristics to produce devices operating effectively at very different rates of rotation.

It is preferable that arrays of more than three orbiters employ rigid orbiters to minimize the likelihood of tangling and to render operation more fluid. A rigid orbiter will not collapse upon itself if sufficient speed is not maintained as will a flexible orbiter, and rigid orbiters are not subject to tangling at each orbiter-to-orbiter collision. However, experienced operators may appreciate the challenge offered by flexible orbiters.

Also, with each additional orbiter in an array there is a corresponding lessening of the maneuverability of the assembly. Arrays of two orbiters are well suited to operation involving pivoting movements of the operator's body, and thus to performance applications, whereas such movements with an array of seven orbiters is likely, if not guaranteed, to provoke collapse of the mechanism.

With arrays incorporating same-length orbiters there is the added difficulty of confusion of the orbiters and these are best suited to arrays of lesser number. In addition, collision of same-length orbiters is more likely to provoke collapse of the mechanism since orbiter end collisions are more direct than collisions along the length of the orbiters, which tend to be more glancing in nature.

Handles:

A variety of integral or non-integral handles may be employed for support of the bearing-bail-orbiter assembly. Certain ergonomic variations to the handle are possible, including, but not limited to changes in the angle of the bearing surface relative to the length of the handle. In configurations where the bail rotates on an axis parallel to the length of the handle changes to the attitude of the rotating bail are made by inclining the assembly. In configurations where the axis of rotation of the bail is misaligned with the length of the handle, such changes in attitude may be made by causing the handle to rotate on an axis parallel to its length. In this way one may minimize the movements necessary to operate the device and may fine-tune attitudinal changes with less effort. Such configurations may also be employed to minimize the likelihood of collision of the whirling orbiters with the back of the operator's hand.

This great variety of components not withstanding, the elementary functional components of the mechanism remain the bearing, bail, and orbiter array, and their interaction based on the principles of pendular and gyroscopic movement as described above and illustrated in the accompanying figures.

BRIEF DESCRIPTION OF DRAWINGS

The attached figures represent various modes of the present invention and together, with the basic description above and description of best modes following complete the disclosure of the device.

FIG. 3*a* is a left side orthogonal view of an exemplary handle, bearing structure, and bail of one embodiment of the present invention.

FIG. 3*b* is a left side orthogonal view of the bearing structure of the embodiment of FIG. 3*a*.

FIG. 3*c* is a front side orthogonal view of the bail of the embodiment of FIG. 3*a*.

FIG. 3*d* is a front side orthogonal view of the distal end of the handle of the embodiment of FIG. 3*a*.

DRAWINGS—REFERENCE NUMERALS

Figure 1:
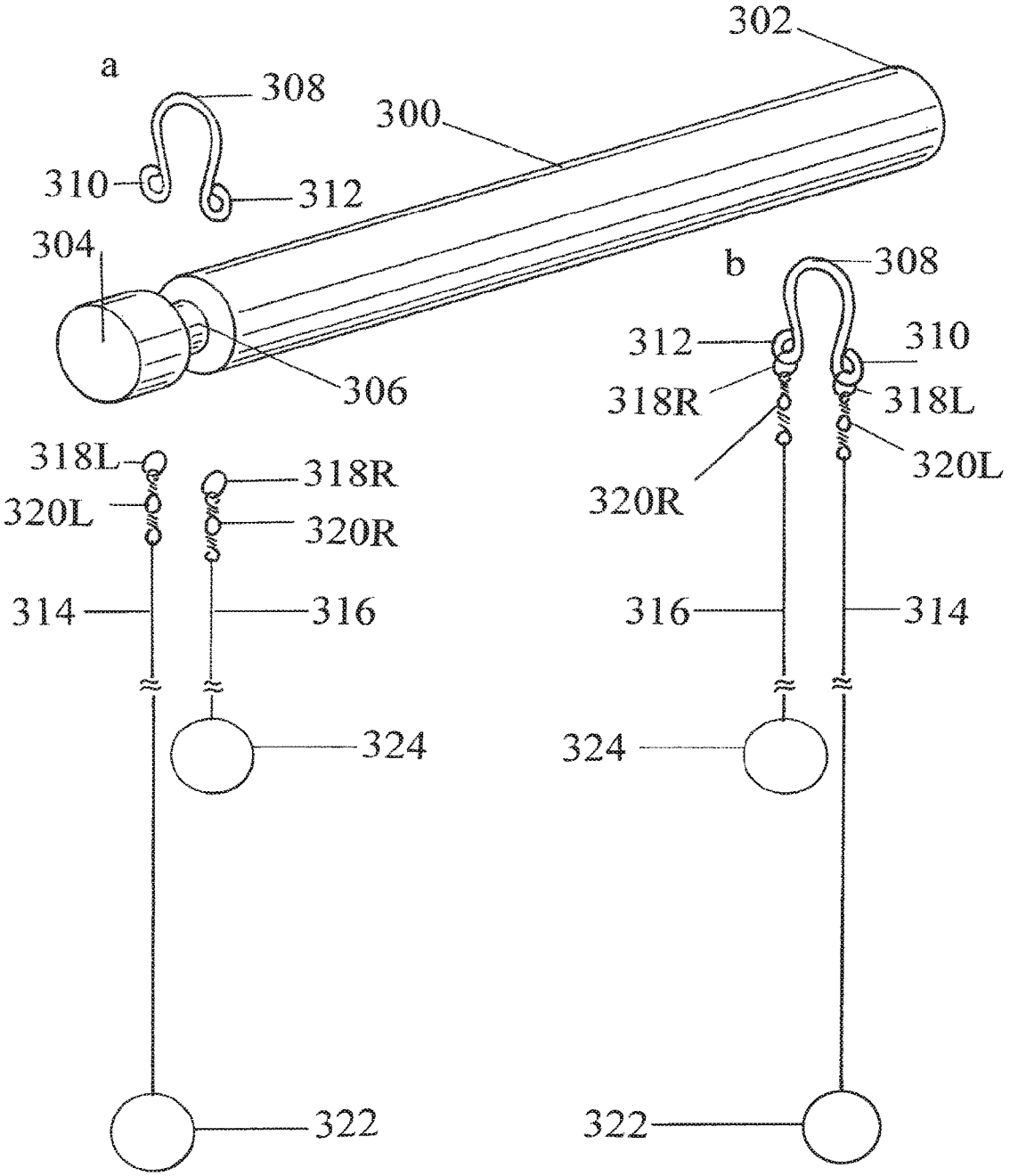
FIG. 1*a* is an exploded isometric view of one exemplary two-orbiter embodiment, presented with integral handle and flexible orbiters, configured for right-handed operation.
FIG. 1*b* is an isometric view of the bail and the array of orbiters as in FIG. 1*a* rotated for left-handed operation.

300—handle
302—proximal end
304—distal end
306—channel
308—bail
310, 312—eyelet
314, 316—orbiter
318L, 318R-split ring
320L, 320R—swivel
322, 324—bead
326—hand
328L, 328R—arrow
330—handle
332—proximal end
334—distal end
336—end cap
338—bearing surface
340—bail
342—throughbore
344 through 356—mounting hole
358—split-ring
360—orbiter
362—eyelet
364—light-emitting object
366—repositionable mass
368—cylindrical void
370 through 382—orbital paths

DRAWINGS

FIG. 1*a* is an exploded isometric view of an exemplary embodiment of the present invention. Integral handle 300 consists of a cylinder of wood having a proximal end 302 and a distal end 304. Handle 300 is incised around its circumference at a distance of one centimeter from distal end 304 with a channel 306 to act as the integrated bearing surface for the removable and repositionable bail 308.

Bail 308 consists of a length of wire shaped at its extremities to form eyelets 310 and 312, and bent into the form shown, having a maximum internal diameter slightly larger than the minimum diameter of channel 306, allowing it to rotate freely around handle 300 when clipped onto it at channel 306.

The form of bail 308 prevents its accidental removal but allows its deliberate removal from handle 300, with orbiters 314 and 316 attached, for replacement with another bail equipped with different orbiters or for the purposes of converting the device from a configuration better suited to operation with the right or left hand to one better suited to operation with the other hand. This latter is accomplished by removing bail 308 and rotating it 180 degrees on a vertical axis so that the positions of extremities 310 and 312 and those of attached orbiters 314 and 316 are reversed as illustrated in FIG. 1*b*.

The two orbiters 314 and 316 consist of unequal lengths of braided cord or other suitable flexible material attached at their proximal ends to bail 308 with identical conventional split rings 318L and 318R and identical conventional barrel swivels 320L and 320R to which they may be tied or attached through other appropriate means. Conventional barrel swivels are employed here, but any suitable swivel mechanism may be used. Orbiters 314 and 316 are weighted at their distal ends with conventional beads 322 and 324, which must be of sufficient mass to assure the tension and easy rotation of orbiters 314 and 316, to which they are attached in an appropriate manner.

FIG. 1*b* presents bail 308 rotated horizontally, with extremities 310 and 312 and attached orbiters 314 and 316 in positions opposite those illustrated in FIG. 1*a*, and thus configured for left-handed operation.

FIG. 2*a* is an isometric view of the embodiment as in FIG. 1 in the right hand 326 of an operator, with the elements serving for the attachment of orbiters 314 and 316 to bail 308 (see FIGS. 1*a* and 1*b*) omitted for simplicity. Bail 308 is clipped into channel 306. Arrows 328L and 328R indicate the primary clockwise rotation of orbiters 314 and 316.

FIGS. 2*b* through 2*e* are views of this embodiment of the present invention in operation from the perspective of an operator and in which the paths of orbiters 314 and 316 are indicated by circles numbered accordingly. They illustrate the sequence of movements and orientations necessary for the basic operation of the present invention. Imaginary points in space toward which the device is directed to varying degrees for this basic operation are here indicated by Roman numerals I through V, and are hereinafter referred to as imaginary point I, imaginary point II, etc.

Referring to FIGS. 2*a* through 2*e*, the following steps provide a brief outline of operation with the right hand:

Step One: The operator holds handle 300 horizontally in the right hand 326 with distal end 304 directed forward toward imaginary point I and whirls orbiters 314 and 316 in a clockwise direction, as indicated by directional arrows 328L and 328R, at a speed sufficient to establish and maintain their radial orientation in relation to bail 308 (see FIG. 2*a*).

Step Two: When consistent smooth and relaxed rhythm is established, the operator directs distal end 304 upward and left a few degrees toward imaginary point II prompting the precession of orbiters 314 and 316. The shorter orbiter 314 will react more quickly and to a greater degree than will the longer orbiter 316 (see FIG. 2*b*).

Step Three: When the precession of orbiter 314 is apparent, and before orbiter 316 may move to join it on the new plane of rotation, the operator directs distal end 304 a few degrees downward past horizontal toward imaginary point III (see FIG. 2*c*).

Step Four: Maintaining the degree of separation between the planes of rotation of orbiters 314 and 316, the operator orients distal end 304 right toward imaginary point IV (see FIG. 2*d*).

Step Five: Maintaining the degree of separation between the planes of rotation of orbiters 314 and 316 the operator orients distal end 304 up toward imaginary point V (see FIG. 2*e*).

Step Six: The operator repeats steps two through five, moving smoothly through them in a circular manner, and increasing or decreasing the degree of orientation of distal end 304 toward the imaginary points II through V and the speed of whirling of the array as necessary to maintain the separation of the planes of rotation of orbiters 314 and 316.

Operation of the same embodiment configured for the left hand proceeds in the same manner, with the sense of rotation and the sequence of movements through the imaginary points reversed. A detailed explanatory text concerning this basic operation and subsequent possibilities of movement is to be found in the section titled Operation below.

FIG. 3*a* is a left side orthogonal view of three components of an exemplary embodiment of the present invention comprising an integral handle 330 having a proximal end 332 and a distal end 334 terminating in a substantially hemispherical structure. Inserted and appropriately secured in distal end 334 in permanent or removable fashion is an end cap 336 of substantially hemispherical form and presenting a cylindrical bearing surface 338 for bail 340.

FIG. 3*b* is a left side orthogonal view of end cap 336 showing cylindrical bearing surface 338.

FIG. 3*c* is a front side orthogonal view of bail 340 which has a throughbore 342 of sufficient diameter to allow its easy rotation on bearing surface 338 (FIG. 3*b*). It is equipped with orbiter mounting holes 344, 346, 348, 350, 352, 354, and 356, for a total of seven, corresponding to the number of electron shells known to atoms, arranged on an arc of less than 180 degrees which is concentric with throughbore 342. To orbiter mounting hole 350 is attached a standard split-ring 358 which serves as a flexible coupling for exemplary orbiter 360 (other orbiters not shown). Orbiter 360 is composed of a length of rigid material having a proximal end eyelet 362 and a distal end light-emitting object 364 of decorative form consistent with the nature of the present invention. Between proximal end eyelet 362 and distal end 364 is a repositionable mass 366 of sufficient mass to affect the pendular and gyroscopic behavior of exemplary orbiter 360.

FIG. 3*d* is a front side orthogonal view of the distal end 334 of handle 330 (FIG. 3*a*) showing a cylindrical void 368 for the placement of cylindrical bearing surface 338 (FIGS. 3*a* and 3*b*).

Figures 3, 4:
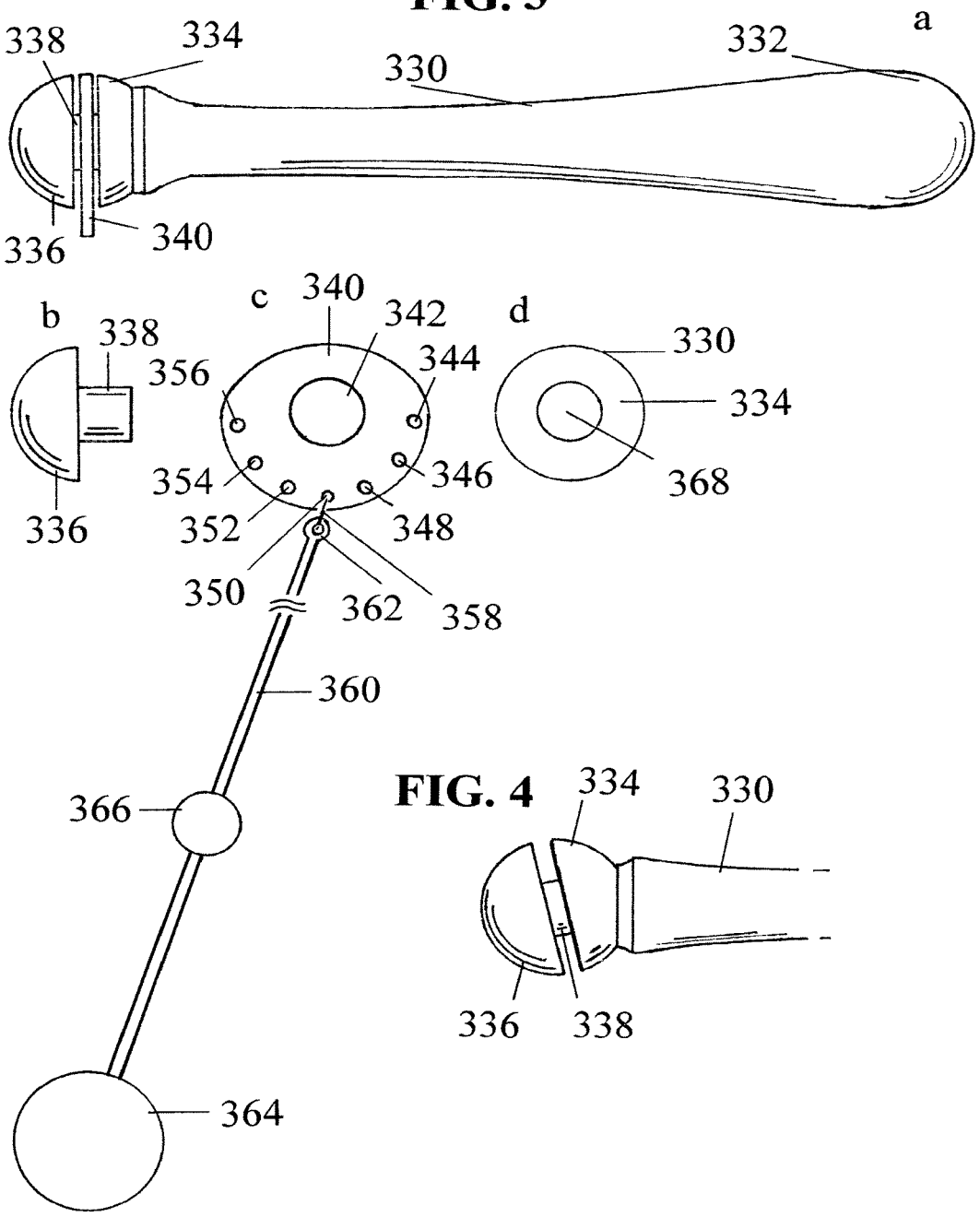
FIG. 4 is a left side orthogonal view of an example ergonomic variation to the embodiment of FIG. 3.

FIG. 4 is a left side orthogonal view of an exemplary ergonomic variation of the embodiment of FIG. 3 in which the distal end 334 of handle 330 presents a substantially hemispherical structure here angled downward relative to the body of handle 330 and thus affecting the orientation of attached end cap 336 and cylindrical bearing surface 338.

Figure 5:
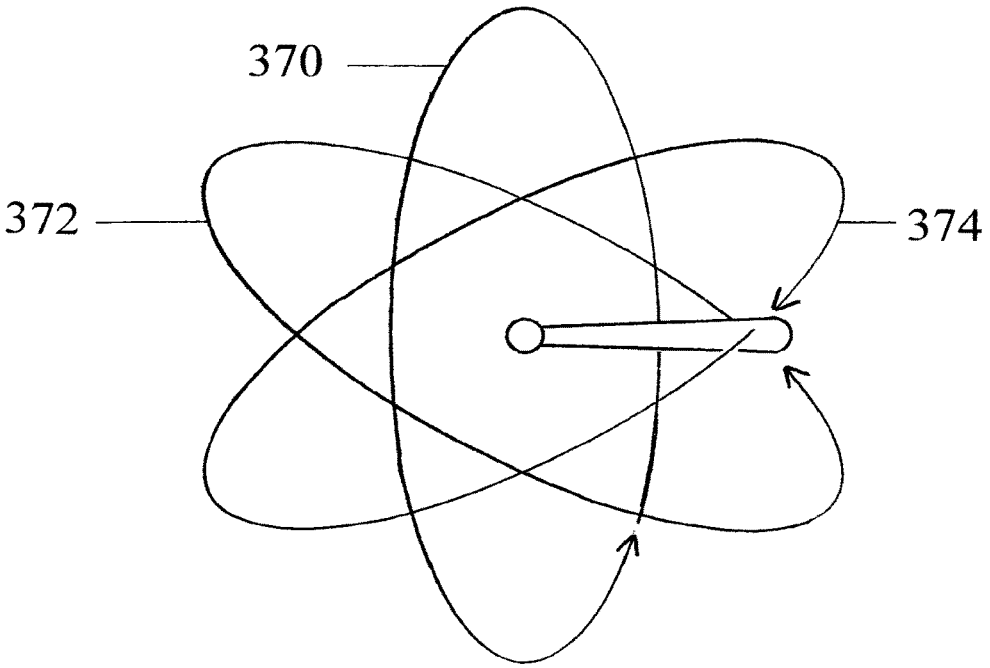
FIG. 5 is a left side orthogonal view of the embodiment of FIG. 3 equipped with an array of 3 orbiters of identical length, showing the orbital paths of the array at one stage of right-handed operation.

FIG. 5 is a left side orthogonal view of the embodiment of FIG. 3 at one point in its operation and showing the orbital paths 370, 372, and 374 of an array of three orbiters of equal length.

Figure 6:
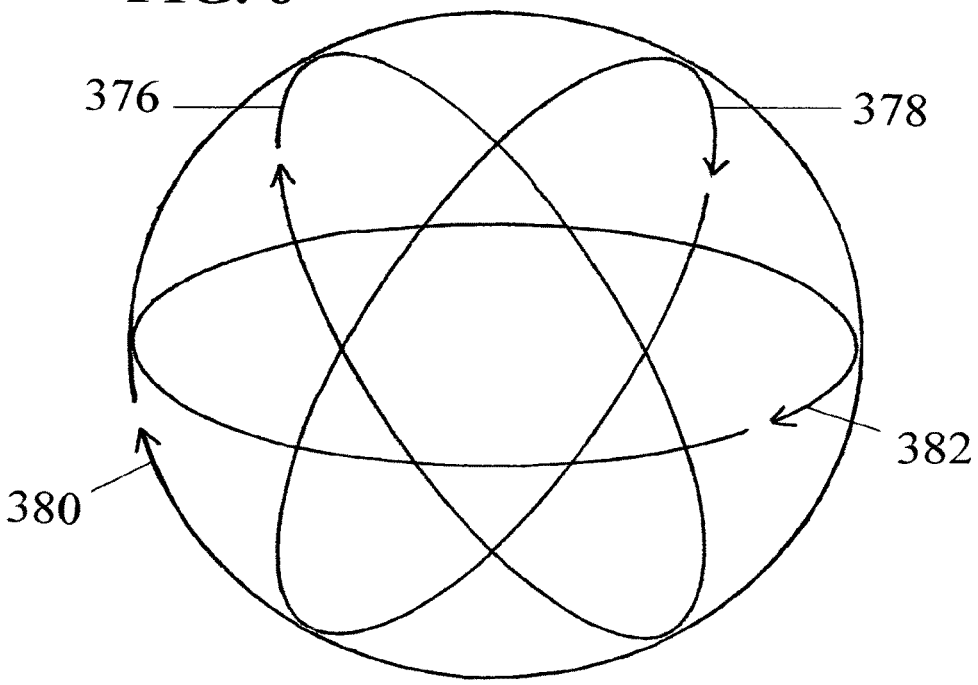
FIG. 6 is an orthogonal view, from the perspective of an operator, of the orbital paths of an array of four orbiters of equal length at one stage of right-handed operation.

FIG. 6 is an orthogonal view from the perspective of an operator showing the orbital paths 376, 378, 380, and 382 of four orbiters of equal length.

Figure 2:
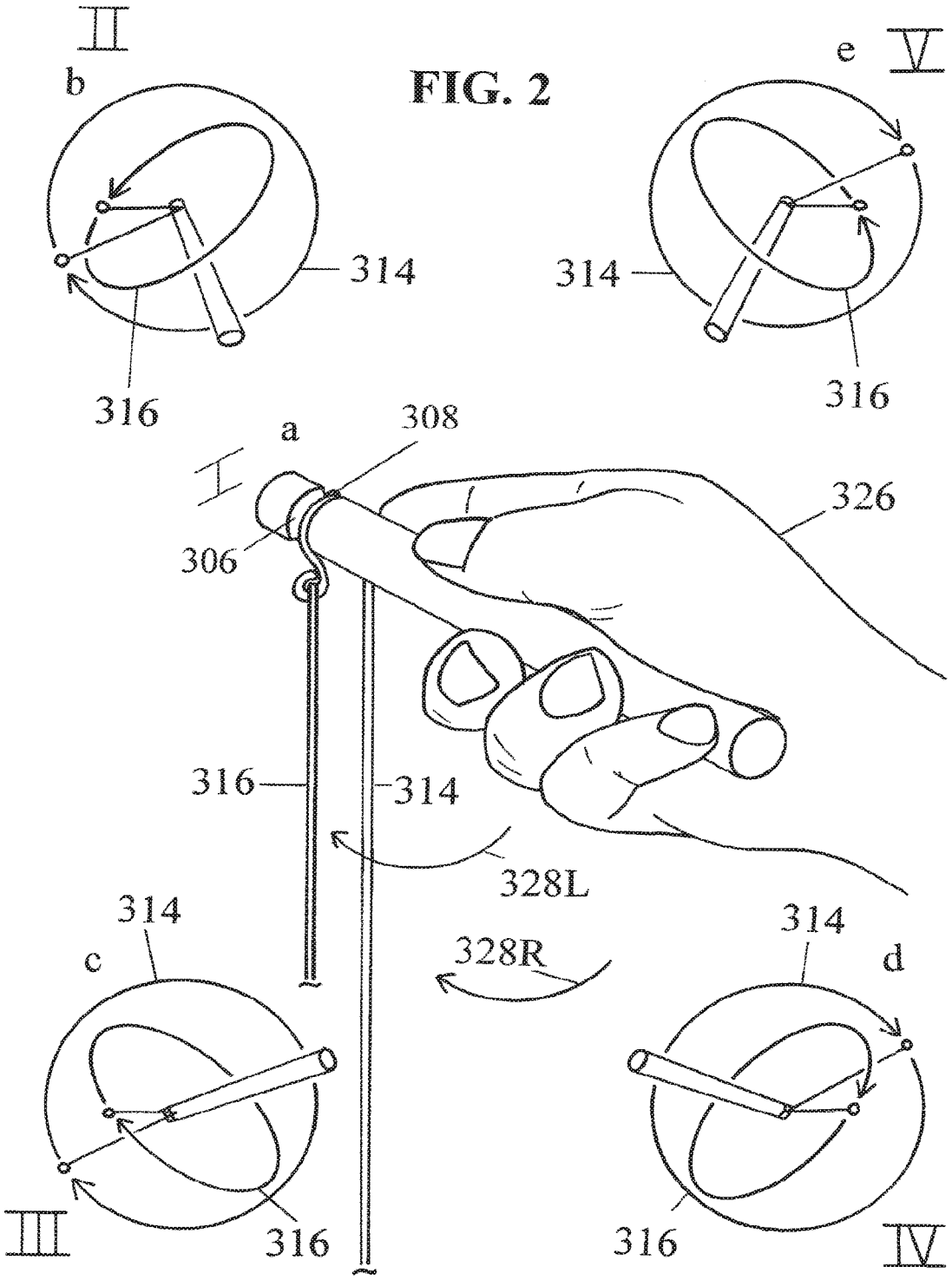
FIG. 2*a* is an isometric view of the embodiment as in FIG. 1 in the right hand of an operator.
FIGS. 2*b* through 2*e* show a sequence of orientations necessary for the basic right-handed operation of the mechanism and the ideal positions of the two orbiters at each orientation with arrows indicating the trajectories of the orbiters.

Operation—Referring to the Two-Orbiter Configuration of FIGS. 1 and 2

For the purposes of this explanation, I refer again to FIG. 2. In this illustration the lengths of the orbiters increase from left to right from the viewpoint of the operator, and it is therefore best suited from an ergonomic standpoint for operation with the right hand, though operation with the left hand is possible.

Operation of the mechanism equipped with arrays of a greater number of orbiters is substantially the same as that explained here, but practice with a two-orbiter array is a necessary prerequisite, and an operator skilled in said operation will have no difficulty in extending the principles to more complex arrays.

The manipulations outlined in the discussion of the attached figures and narrated in this section describe everything necessary for an inexperienced operator to learn to perform the basic operation of the present invention, although more time may be necessary for the operator to succeed at any given step than is apparent in the description.

To use the mechanism, the operator holds the handle in a horizontal position with its distal end toward Imaginary Point I (FIG. 2*a*). The operator then imparts a clockwise circular motion to the orbiters and continues whirling them around this axis at a rate sufficient to maintain their radial orientation and at a steady rhythm in order to avoid the collision of the two. At this point the orbiters occupy the same plane of rotation.

To cause the orbiters to occupy different planes of rotation the operator now changes the orientation of the handle, pointing the distal end up a few degrees and to the left toward Imaginary Point II and maintaining the whirling motion. This change in orientation causes both of the orbiters to deviate from their initial plane of rotation due to the inducement of gyroscopic precession. However, the shorter orbiter reacts more quickly than does the longer orbiter; its movement is greater, and is perceived by the operator and observers as independent of that of the longer orbiter.

If this orientation is maintained the shorter orbiter may eventually reach a substantially horizontal orbit and may come into contact with the operator's arm, causing the movement of the device to be interrupted or, barring this, the longer orbiter may precess sufficiently to occupy the same plane as the shorter orbiter. To avoid this situation, the operator continually changes the orientation of the handle, moving the distal end in a counter-clockwise circular path, indicating with the distal end of the handle the Imaginary Points II, III, IV, and V in series.

This continual movement must occur at a rate sufficient to avoid orbiter-arm collision and to maintain the two planes of orbit. As indicated above, if the movement through the cycle of imaginary points is too slow the longer orbiter will deviate from its plane of rotation and will move to join the shorter, more reactive orbiter. If the movement is too quick arm-orbiter or orbiter-orbiter collision may occur. In this explanation of basic operation the handle is initially held in a horizontal position, but it important to note that operation may proceed as described regardless of the initial orientation of the handle provided that the sequence of changes in orientation is respected relative to the initial plane of rotation of the orbiters.

As the operator gains proficiency this sequence of movements through the imaginary points will become more natural, more fluid and better controlled. Physical and mental concentration, leading to muscular and intellectual memory, renders the basic movements almost automatic, at which point ease of operation allows other movements to be performed.

Examples of other movements include:

Large or small arcs or full circles in any direction, to be described by close-in or arms-length movement;

Pivoting movements of the operator's entire body, having for their axis the operator's vertical center of gravity;

Linear movements, of any length, in any direction, whether or not in the same plane as one of the orbiters;

Combinations of all of these.

The effect of these alternate movements is particularly interesting, as they may be used to cause rapid changes in orientation to a specific orbit. Movements in line with a specific plane will tend to reduce the precession of the occupying orbiter and it is also possible to pull an orbiter into a different plane of rotation by changing not the attitude of but the location of the axis. It is in this way possible to isolate one or the other orbiter and to concentrate on its movement, the simplest example being to cause the ring described by the object borne by the longer orbiter to become more dynamic and to revolve around the ring described by the object borne by the shorter orbiter. In addition, as the speed of revolution and rate of precession of the orbiters increase, smaller changes in attitude are sufficient to maintain precession or to cause changes in behavior, and it is possible for an experienced operator to use the device with almost no perceptible changes in the attitude of the handle.

BEST MODE FOR CARRYING OUT THE INVENTION

The best mode envisioned at the time of this writing is a hand-held device comprising an integral or non-integral handle, a bearing surface, interchangeable rotating structures (bail), and interchangeable arrays of pendulums (orbiters) of different types including pendulums (orbiters) with light-emitting components.

The invention claimed is:

1. A mechanical assembly characterized by:

(a) a bearing or bearing surface which may be integral or non-integral to a handle;

(b) a single freely rotating section which may be permanently or removably positioned upon, and which is free to rotate through 360 degrees upon or around, the bearing or bearing surface and itself presenting, within a segment of no more than 180 degrees as measured from the axis of rotation, distinct points of attachment fixed within a common plane for;

(c) an array of two or more pendulums which may be permanently or removably attached to the single freely rotating section at respective attachment points, are free-swinging directly from their respective attachment points, and whose attached ends are, by reason of their attachment to the single freely rotating section, constrained to a common sense of revolution around the bearing or bearing surface and within the common plane.

2. A whirling toy, comprising:

an elongate handle;

a single bail rotatably coupled about an axis to the elongate handle and within a plane; and two or more pendulums attached to the bail and freely swinging at spaced-apart attachment points within the plane, wherein the spaced-apart attachment points are fixed relative to each other in all directions and within the plane, so that when the bail rotates about the axis, the attachment points revolve about the axis, within the plane, and all in the same direction, while the two or more pendulums are permitted to swing out of the plane because they are freely swinging from the attachment points.

3. The whirling toy of claim 2, wherein the two or more pendulums are weighted at their respective distal ends.

4. The whirling toy of claim 2, wherein the two or more pendulums are flexible.

5. The whirling toy of claim 2, wherein the two or more pendulums are rigid.

6. The whirling toy of claim 2, wherein the two or more pendulums are equal in length.

7. The whirling toy of claim 2, wherein the two or more pendulums are unequal in length.

8. The whirling toy of claim 2, wherein the elongate handle defines a channel with a cylindrical bearing surface, and wherein the bail is positioned within the channel to rotate about the cylindrical bearing surface.

9. The whirling toy of claim 2, wherein the two or more pendulums include three or more pendulums attached to the bail at spaced-apart attachment points, wherein the spaced-apart attachment points are arranged in a linear fashion.

10. The whirling toy of claim 2, wherein the two or more pendulums include three or more pendulums attached to the bail at spaced-apart attachment points, wherein the spaced-apart attachment points are arranged in a non-linear fashion.

11. The whirling toy of claim 2, wherein the two or more pendulums include three or more pendulums attached to the bail at spaced-apart attachment points, wherein the spaced-apart attachment points are arranged in an arcuate fashion.

12. The whirling toy of claim 2, wherein the two or more pendulums include one or more of light-emitting elements and sound-emitting elements.

13. The whirling toy of claim 2, wherein the two or more pendulums each include a movable weight that is repositionable along a length of its respective pendulum.

14. The whirling toy of claim 2, wherein the bail is configured to be removed from the elongate handle, rotated 180 degrees, and reattached to the elongate handle in a reversed orientation.

15. The whirling toy of claim 2, wherein the bail is free to slide from one end of the elongate handle to another end of the elongate handle.

16. A method of operating the whirling toy of claim 2, comprising:

grasping the elongate handle;

moving the elongate handle so that a first of the two or more pendulums travels in a first plane and so that a second of the two or more pendulums travels in a second plane that is transverse to the first plane; and maintaining movement of the first and second pendulums in their respective planes for a period of time without the first and second pendulums colliding with each other.

17. A method of operating the whirling toy of claim 2, the method comprising:

grasping the elongate handle; and whirling the two or more pendulums about the elongate handle while directing a distal end of the elongate handle in a circular motion.

18. A method of operating the whirling toy of claim 2, the method comprising:

first, grasping the elongate handle;

second, whirling the two or more pendulums about the elongate handle in a common plane; and third, directing a distal end of the elongate handle in a circular motion so that the two or more pendulums diverge from the common plane and continue to whirl in distinct planes from each other.

19. A method of operating the whirling toy of claim 2, the method comprising:

first, grasping the elongate handle;

second, whirling the two or more pendulums clockwise about the elongate handle in a common plane; and third, directing a distal end of the elongate handle sequentially from (i) up and to the left, (ii) down and to the left, (iii) down and to the right, (iv) up and to the right, and (v) repeating (i)-(iv).

20. A method of operating the whirling toy of claim 2, the method comprising:

first, grasping the elongate handle;

second, whirling the two or more pendulums counter clockwise about the elongate handle in a common plane; and third, directing a distal end of the elongate handle sequentially from (i) up and to the right, (ii) down and to the right, (iii) down and to the left, (iv) up and to the left, and (v) repeating (i)—(iv).

21. The whirling toy of claim 2, wherein the bail includes two or more orbiter mounting holes that respectively correspond to and define the spaced-apart attachment points for the two or more pendulums, the whirling toy further comprising:

two or more connecting rings that interconnect respective ends of the two or more pendulums to the two or more orbiter mounting holes.

22. The whirling toy of claim 2, wherein the bail includes two or more orbiter mounting holes that respectively correspond to and define the spaced-apart attachment points for the two or more pendulums, the whirling toy further comprising:

two or more swivel mechanisms that interconnect respective ends of the two or more pendulums to the two or more orbiter mounting holes so that the two or more pendulums may freely spin relative to the bail.

23. The whirling toy of claim 2, wherein the bail is defined by a plate with two or more orbiter mounting holes that respectively correspond to and define the spaced-apart attachment points for the two or more pendulums.

24. The whirling toy of claim 2, wherein the elongate handle defines a longitudinal axis and wherein the plane within which the single bail rotates is at a non-right angle relative to the longitudinal axis.

25. The whirling toy of claim 2, wherein the spaced-apart attachment points are all bound by an angle of less than 180 degrees relative to the axis.

26. A whirling toy, comprising:

a bail configured to be rotatably coupled to a handle about an axis; and two or more pendulums attached to the bail and freely swinging at spaced-apart attachment points within a common plane, wherein the spaced-apart attachments points are fixed relative to each other in all directions within the common plane, so that when the bail is coupled to the handle and rotates about the axis, the attachment points revolve about the axis within the common plane, and all in the same direction, while the two or more pendulums are permitted to swing out of the common plane because they are freely swinging from the attachment points.

* * * * *